US009015898B2

(12) United States Patent
Nguyen

(10) Patent No.: US 9,015,898 B2
(45) Date of Patent: Apr. 28, 2015

(54) EXTRACTION CLEANER WITH HEAT TRANSFER

(71) Applicant: BISSELL Homecare, Inc., Grand Rapids, MI (US)

(72) Inventor: Tom Minh Nguyen, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 63 days.

(21) Appl. No.: 14/016,652

(22) Filed: Sep. 3, 2013

(65) Prior Publication Data

US 2014/0173847 A1 Jun. 26, 2014

Related U.S. Application Data

(60) Provisional application No. 61/694,582, filed on Aug. 29, 2012.

(51) Int. Cl.

| | |
|---|---|
| ***A47L 11/29*** | (2006.01) |
| ***A47L 5/00*** | (2006.01) |
| ***A47L 11/40*** | (2006.01) |
| ***A47L 11/34*** | (2006.01) |

(52) U.S. Cl.

CPC ..... *A47L 11/4088* (2013.01); *A47L 11/34* (2013.01); *A47L 11/4002* (2013.01); *A47L 11/4083* (2013.01)

(58) Field of Classification Search

USPC ..... 15/320, 322, 327.1, 327.2, 327.6, 15/327.7, 340.1–340.4

See application file for complete search history.

(56) References Cited

U.S. PATENT DOCUMENTS

| | | | | |
|---|---|---|---|---|
| 5,715,566 | A | 2/1998 | Weaver et al. | |
| 5,799,362 | A | 9/1998 | Huffman | |
| 6,131,237 | A | 10/2000 | Kasper et al. | |
| 6,167,586 | B1 | 1/2001 | Reed, Jr. et al. | |
| 7,073,226 | B1 | 7/2006 | Lenkiewicz et al. | |
| 7,228,589 | B2 | 6/2007 | Miner et al. | |
| 7,234,197 | B2 | 6/2007 | Tran | |
| 7,784,148 | B2 * | 8/2010 | Lenkiwicz et al. | 15/322 |
| 7,979,955 | B2 * | 7/2011 | Lenkiewicz et al. | 15/327.2 |
| 2005/0050670 | A1 | 3/2005 | Kumazaki | |
| 2006/0288518 | A1 * | 12/2006 | Lenkiwicz et al. | 15/322 |
| 2009/0094782 | A1 * | 4/2009 | Lenkiewicz | 15/320 |
| 2009/0119868 | A1 * | 5/2009 | Lenkiewicz et al. | 15/320 |
| 2012/0222235 | A1 | 9/2012 | Lenkiewicz et al. | |

* cited by examiner

*Primary Examiner* — Dung Van Nguyen
(74) *Attorney, Agent, or Firm* — McGarry Bair PC

(57) ABSTRACT

An extraction cleaner for cleaning a floor surface includes a liquid distribution system and a liquid recovery system. The liquid recovery system includes a motor, and a motor cooling air pathway provides cooling air to the motor and removes heated cooling air from the motor. A duct system delivers heated motor cooling air to a supply tank of the extraction cleaner to heat liquid contained therein, and also drains liquid from the supply tank away from the motor.

20 Claims, 8 Drawing Sheets

EXTRACTION CLEANER WITH HEAT TRANSFER

CROSS-REFERENCE TO RELATED APPLICATION

This application claims the benefit of U.S. Provisional Application No. 61/694,582, filed Aug. 29, 2012, which is incorporated herein by reference in their entirety.

BACKGROUND

Extraction cleaners are well-known for deep cleaning carpets and other fabric surfaces, such as upholstery. Most carpet extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. An example of an extractor is disclosed in commonly assigned U.S. Pat. No. 6,131,237 to Kasper et al., which is incorporated herein by reference in its entirety. U.S. Pat. No. 5,715,566 to Weaver discloses an extraction cleaning machine capable of being used as an upright machine, or as a separate extraction cleaning module.

SUMMARY OF THE INVENTION

According to one aspect of the invention, an extraction cleaner for cleaning a floor surface includes a supply tank configured to store a supply of cleaning liquid, a liquid distribution system configured to apply the cleaning liquid to the floor surface, a liquid recovery system configured to recover applied liquid and dirt from the floor surface, the liquid recovery system including a recovery tank configured to store recovered cleaning liquid and dirt, a suction nozzle in fluid communication with the recovery tank, and a motor generating working air flow, a motor-cooling air pathway providing cooling air to the motor and for removing heated cooling air from the motor, and a duct system fluidly downstream of the motor and including a heat transfer duct fluidly coupled to the motor-cooling air pathway and delivering heated motor cooling air from the motor to the supply tank to heat the cleaning liquid stored therein and a drain outlet fluidly coupled to the heat transfer duct, wherein the drain outlet drains cleaning liquid that enters the heat transfer duct away from the motor.

BRIEF DESCRIPTION OF THE DRAWINGS

The invention will now be described with respect to the drawings in which.

DESCRIPTION OF EMBODIMENTS OF THE INVENTION

The invention relates to a surface cleaning apparatus that delivers cleaning fluid to a surface to be cleaned and extracts spent cleaning fluid and debris from the surface. In one of its aspects, the invention relates to an upright extraction cleaner having means for heating fluid in a fluid supply tank.

Figure 1:
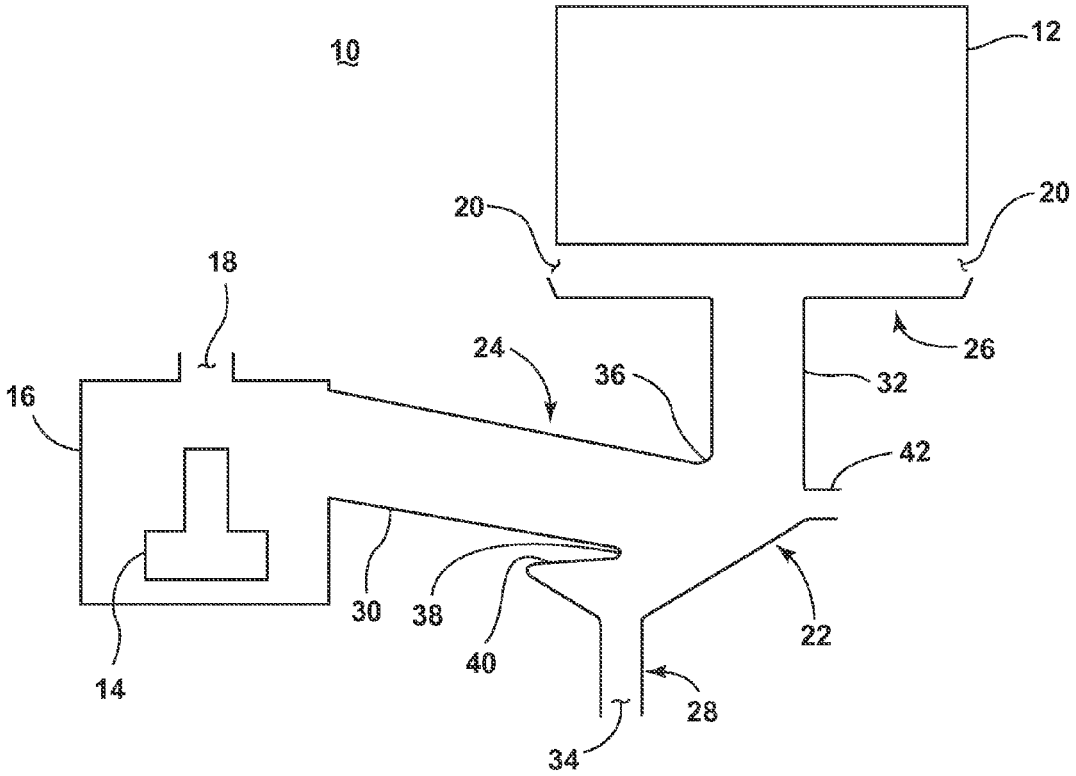
FIG. 1 is a schematic view of a portion of an extraction cleaner according to a first embodiment of the invention.

Referring to the drawings and particularly to FIG. 1, a schematic illustration of a portion of an extraction cleaner 10 according to a first embodiment of the invention comprises a liquid supply tank 12 and a motor 14 provided within a motor housing 16. The supply tank 12 can store a supply of cleaning liquid, which can be applied to a surface to be cleaned using a liquid distribution system. The motor 14 can be part of a liquid recovery system, and can generate a working air flow used to recover spent liquid and dirt from the surface.

A motor-cooling air pathway is provided in the extraction cleaner 10 for providing cooling air to the motor 14 and for removing heated cooling air (also referred to herein as "heated air") from the motor 14. The motor-cooling air pathway includes an inlet 18 which is fluidly upstream of the motor 14, and an outlet 20 which is fluidly downstream of the motor 14. Both the inlet 18 and the outlet 20 can be provided in the motor housing 16 and are in fluid communication with the ambient air outside the extraction cleaner 10. A portion of the motor-cooling air pathway downstream of the motor 14 can extend near the supply tank 12, such that cooling air heated by the motor 14 can be used to heat the liquid inside the supply tank 12.

A duct system 22 is provided which permits heated motor cooling air to be delivered from the motor 14 to the supply tank 12, but which does not permit liquid from the supply tank 12, i.e. due to leakage from the supply tank 12, to enter the motor 14. The duct system 22 can include a heat transport duct 24, a heat transfer duct 26, and a liquid drain duct 28. As shown herein, the heat transport duct 24 can extend from the motor 14 to the supply tank 12 for allowing heated motor cooling air to be transported away from the motor 14 toward the supply tank 12. The heat transport duct 24 can have an angled duct segment 30 which juts outwardly from the outlet 20 in the motor housing 16 to join to a vertical duct segment 32. The vertical duct segment 32 opens to the heat transfer duct 26, which is open to or in contact with a portion of the supply tank 12. The liquid drain duct 28 extends downwardly from the heat transport duct 24 to a drain outlet 34 from the extraction cleaner 10. The angled duct segment 30 joins the vertical duct segment 32 at an upper corner 36 and joins the liquid drain duct 28 at a lower corner 38. A ribbed section 40 is provided at the lower corner 38. An optional air bleed hole 42 can be provided in the vertical duct segment 32 for venting a portion of the heated motor cooling air from the duct system 22. The presence of the bleed hole 42 can reduce overheating of the motor 14 by limiting backpressure within the duct system 22 and increasing the volume of cooling air that can pass over the motor 14.

Figure 2:
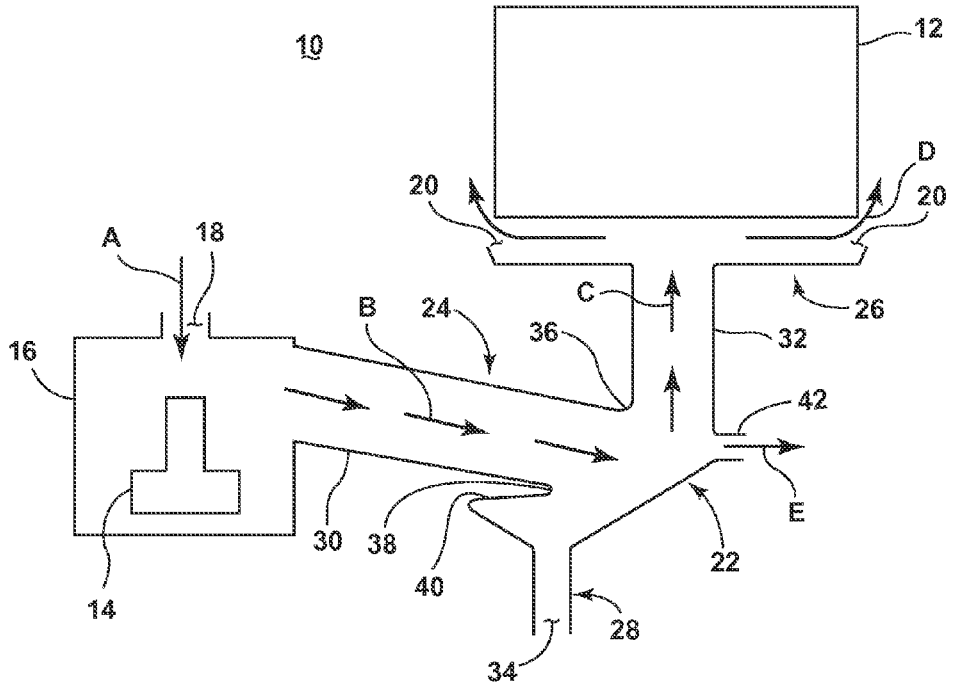
FIG. 2 is a view similar to FIG. 1, illustrating the flow of motor cooling air through the extraction cleaner.

FIG. 2 illustrates the flow of motor cooling air through the duct system 22. During operation of the motor 14, ambient cooling air enters the motor housing 16 through the inlet 18, as indicated by arrow A. As the cooling air passes the motor 14, heat from the motor 14 is transferred to the cooling air, thereby cooling the motor 14 and heating the cooling air. The heated cooling air ("heated air") exits the motor housing 16 via the angled duct segment 30, which directs the heated air into the vertical duct segment 32, as indicated by arrow B. The ribbed section 40 helps guide heated air upwardly to the vertical duct segment 32, rather than into the liquid drain duct 28, by creating a tortuous air path. The heated air flows upwardly to the heat transfer duct 26, and flows adjacent to the supply tank 12, as indicated by arrow C. While in the heat transfer duct 26, heat from the heated air is transferred to the liquid inside the supply tank 12. As the heated air passes through the heat transfer duct 26, and heat is transferred to the supply tank 12, the heated air will cool. The cooled air can have the same temperature as the ambient cooling air drawn in through the inlet 18, or may be slightly warmer or cooler. The cooled air will then exit the extraction cleaner 10 as indicated by arrow D. A portion of the heated air can be vented from the duct system 22 via the bleed hole 42, as indicated by arrow E.

Figure 3:
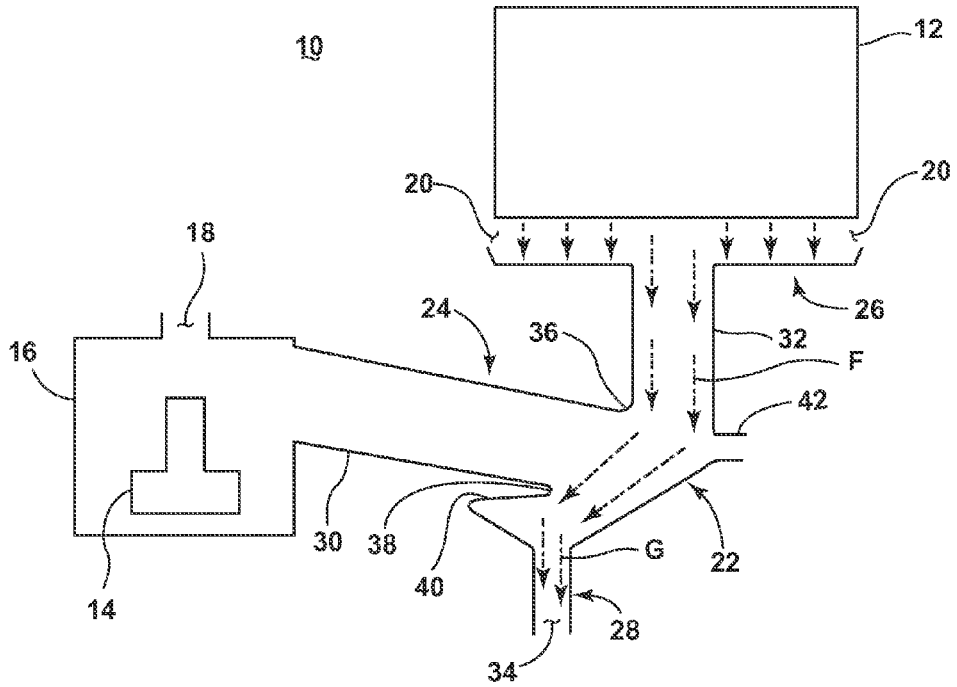
FIG. 3 is a view similar to FIG. 1, illustrating the flow of liquid through the extraction cleaner.

FIG. 3 illustrates the flow of liquid through the duct system 22. Liquid can leak from the supply tank 12 during installation or removal of the supply tank 12 from the extractor 10, or the exterior of the supply tank 12 can be wet from the filling process. Liquid from the supply tank 12 falls into the liquid drain duct 28 via the vertical duct segment 32 and/or the heat transfer duct 26, as indicated by arrow F, and passes out of the extraction cleaner 10 via the drain outlet 34, as indicated by arrow G. The angled duct segment 30 is provided at an upwardly inclined angle to the vertical duct segment 32 in order to prevent liquid from entering the motor housing 16 and motor 14. Further, the corners 36, 38 of the angled duct segment 30 can be offset, such that the upper corner 36 is closer to the center of the vertical duct segment 32 than the lower corner 38, which directs liquid toward the liquid drain duct 28 rather than toward the angled duct segment 30.

Figure 4:
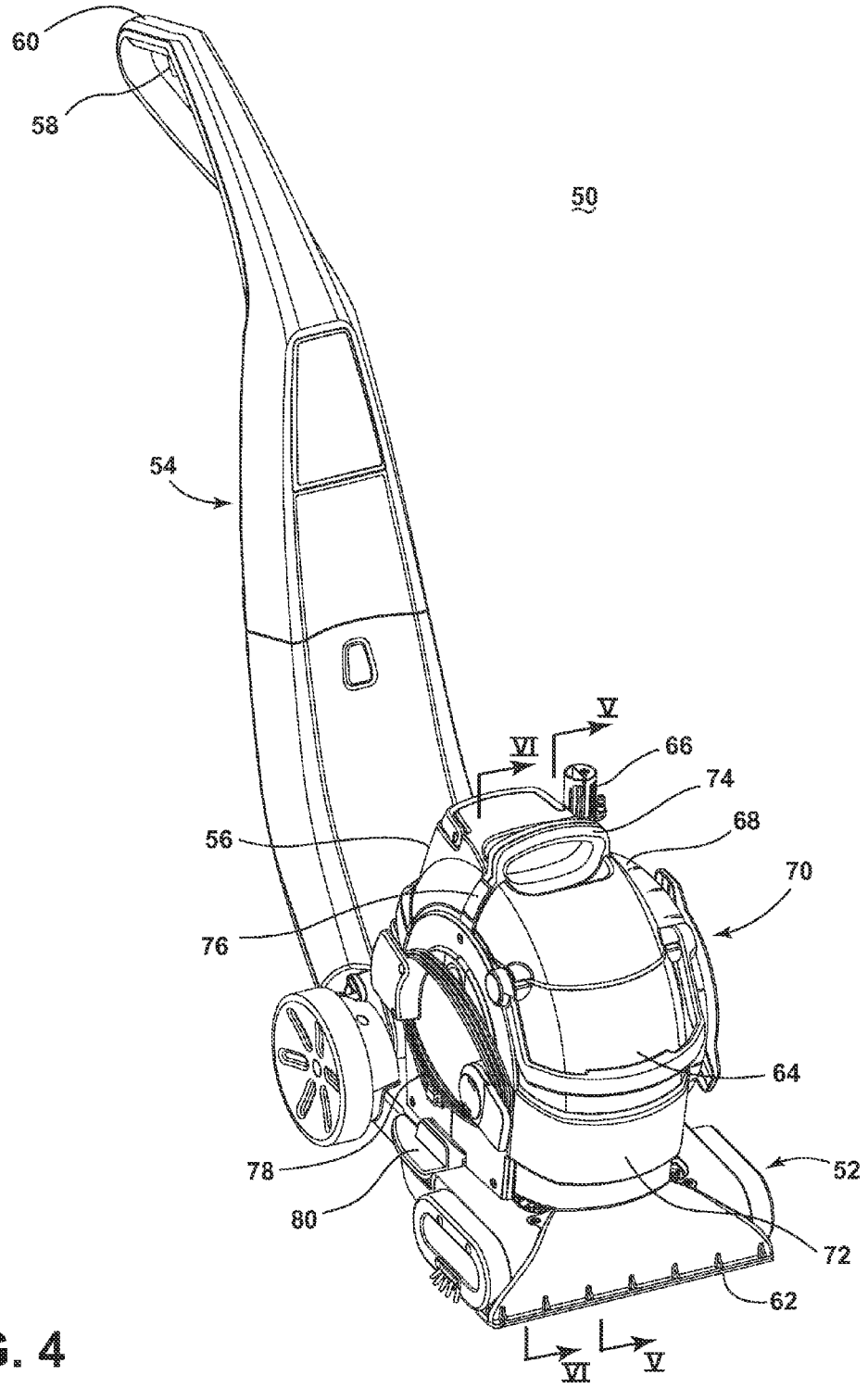
FIG. 4 a front perspective view of an extraction cleaner according to a second embodiment of the invention, the extraction cleaner having a handle assembly, a base assembly, and a detachable pod supported by the base assembly.

FIG. 4 illustrates an extraction cleaner 50 according to a second embodiment of the invention. The duct system schematically described in FIGS. 1-3 can be implemented in the extraction cleaner 50. Details of a suitable extraction cleaner that can be used with the invention described herein can be found in U.S. Patent App. Pub. No. 2012/0222235 to Lenkiewicz et al., published Sep. 6, 2012, entitled "Lift Off Deep Cleaner" which is incorporated herein by reference in its entirety. While illustrated in an upright extraction cleaner, it is contemplated that the invention can be used in any type of extraction cleaner, including canister and handheld extractors.

The extraction cleaner 50 comprises a housing having a base assembly 52 for movement across a surface to be cleaned and a handle assembly 54 pivotally mounted to a rearward portion of the base assembly 52 for directing the base assembly 52 across the surface to be cleaned. The extraction cleaner 50 includes a liquid distribution system for storing cleaning liquid and delivering the cleaning liquid to the surface to be cleaned and a liquid recovery system for removing the spent cleaning liquid and dirt from the surface to be cleaned and storing the spent cleaning liquid and dirt. The components of the liquid distribution system and the liquid recovery system are supported by at least one of the base assembly 52 and the handle assembly 54. For purposes of description related to the figures, the terms "upper," "lower," "right," "left," "rear," "front," "vertical," "horizontal," and derivatives thereof shall relate to the invention as oriented in FIG. 1 from the perspective of a user behind the extraction cleaner 50, which defines the rear of the extraction cleaner 50. However, it is to be understood that the invention may assume various alternative orientations, except where expressly specified to the contrary.

The liquid distribution system can include a liquid supply tank 56 for storing a supply of cleaning liquid. The cleaning liquid can comprise one or more of any suitable cleaning liquids, including, but not limited to, water, concentrated detergent, diluted detergent, etc., and mixtures thereof. For example, the cleaning liquid can comprise a mixture of water and concentrated detergent. A trigger 58 on a hand grip 60 of the handle assembly 54 can selectively control the dispensing of cleaning liquid from the liquid supply tank 56.

The liquid recovery system can include an extraction path in the form of a suction nozzle 62 provided on the base assembly 52 and a recovery tank 64 in fluid communication with the suction nozzle 62 for storing recovered cleaning liquid and dirt.

An accessory wand 66 and a flexible hose 68 are provided on the extraction cleaner 50, and can also be considered part of the delivery and recovery systems, and are used for above-the-floor cleaning. The hose 68 can have separate conduits in fluid communication the supply tank 56 and recovery tank 64, respectively.

The base assembly 52 can support a selectively detachable and portable extraction pod 70 at a forward portion thereof, forward being defined as relative to the mounting location of the handle assembly 54 on the base assembly 52. The pod 70 can carry certain components of the delivery and recovery systems, such as the supply tank 56, the recovery tank 64, the accessory wand 66, and hose 68, and includes a pod housing 72 on which in which the supply and recovery tanks 56, 64 are removably received. The pod housing 72 includes a carry handle 74 that is positioned between the tanks 56, 64 and transverse to the extractor 50 for facilitating lifting and carrying the pod 70. A main power switch 76 is mounted in the carry handle 74 and is electrically connected to a power cord 78, and other electrical components of the extractor 50. A latch assembly 80 releasably retains the pod 70 to the base assembly 52. The latch assembly 80 is configured such that the user can selectively remove the pod 70 from the base assembly 52 to use the pod 70 as a portable cleaning apparatus. However, it is also contemplated that the extraction cleaner 50 can be configured such that that pod 70 is not fully detachable and cannot be used separately from the base assembly 52 and handle assembly 54.

Figure 5:
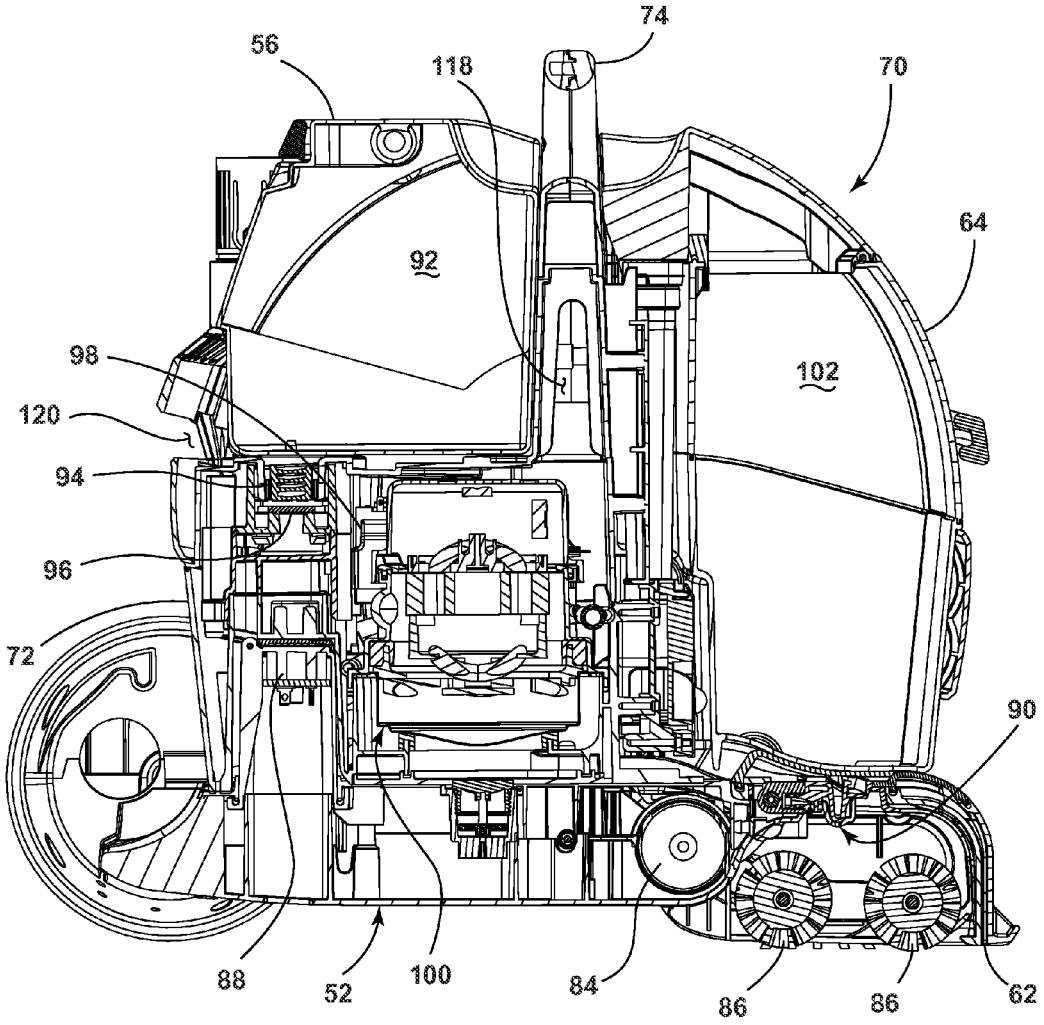
FIG. 5 is a cross-sectional view through line V-V of FIG. 4 showing the base assembly and the pod.

FIG. 5 is a cross-sectional view through line V-V of FIG. 4 showing the base assembly 52 and the pod 70. The base assembly 52 further includes an agitator assembly 82 positioned behind the suction nozzle 62 and an agitator motor 84 for driving the movement of the agitator assembly 82. The agitator assembly 82 comprises one or more rotatably mounted brushroll(s) 86 and a drive mechanism (not shown) for operably connecting the brushroll(s) 86 to the agitator motor 84. The base assembly 52 further comprises a power assembly 88 through which electrical components in the base assembly 52, such as the agitator motor 84, can be electrically connected to the power cord 78 (FIG. 4) on the pod 70.

The liquid distribution system further includes a liquid distributor 90 provided on the base assembly 52 and in fluid communication with the supply tank 56 for depositing a cleaning liquid onto the surface, when the pod 70 is mounted to the base assembly 52. The liquid distributor 90 can be positioned to deposit cleaning liquid onto the brushrolls 86.

The supply tank 56 defines a supply chamber 92 for storing a quantity of cleaning liquid and a valve 94 normally closing an outlet of the chamber 92. When the supply tank 56 is mounted to the pod 70, the valve 94 is opened by a valve seat 96 on the pod housing 72. An exemplary valve and valve seat are disclosed in U.S. Pat. No. 6,167,586, issued Jan. 2, 2001 which is incorporated herein by reference in its entirety. The valve 94 can be removable from the supply tank 56 for filling the chamber 92. A pump 98, only partially visible in FIG. 5, can be provided in fluid communication with the supply tank 56 for moving liquid out of the supply tank 56. However, the pump 98 is optional and can be eliminated in lieu of a commonly known gravity feed liquid distribution system. Liquid exiting the pump 98 can be provided to the liquid distributor 90, when the pod 70 is mounted to the base assembly 52, or to the accessory wand 66 via the hose 68 (FIG. 4) when the pod 70 is removed from the base assembly 52. A diverter assembly (not shown) for switching between the two liquid supply paths depending on the position of the pod 70 can be provided. Various additional components can be incorporated into the liquid distribution system such as liquid control and mixing valves as is commonly known in the art. The supply tank 56 can be selectively removed from the pod 70 in order to refill the supply chamber 92 with cleaning liquid.

The liquid recovery system further includes a motor/fan assembly 100 for generating a working air flow through the recovery tank 64. The recovery tank 64 defines a recovery chamber 102 that is sized to receive a quantity of spent cleaning solution and dirt. The recovery chamber 102 can include an air/liquid separator (not shown) which separates dirt and liquid can from working air. The separated dirt and liquid are stored within the recovery chamber 102, while the working air is passed through the motor/fan assembly 100. When the pod 70 is mounted on the base assembly 52, the recovery chamber 102 is in fluid communication with the suction nozzle 62 and the motor/fan assembly 100, such that a working air path from the suction nozzle 62 to the motor/fan assembly 100 is generated through the recovery chamber 102. When the pod 70 is removed from the base assembly 52, the recovery chamber 102 is in fluid communication with the hose 68 (FIG. 4) and the motor/fan assembly 100, such that a working air path from the hose 68 to the motor/fan assembly 100 is generated through the recovery chamber 102. A diverter assembly (not shown) for switching between the two working air paths depending on the position of the pod 70 can be provided. The recovery tank 64 can be selectively removed from the pod 70 in order to discard the spent cleaning liquid and dirt to an appropriate receptacle or waste drain.

Figure 6:
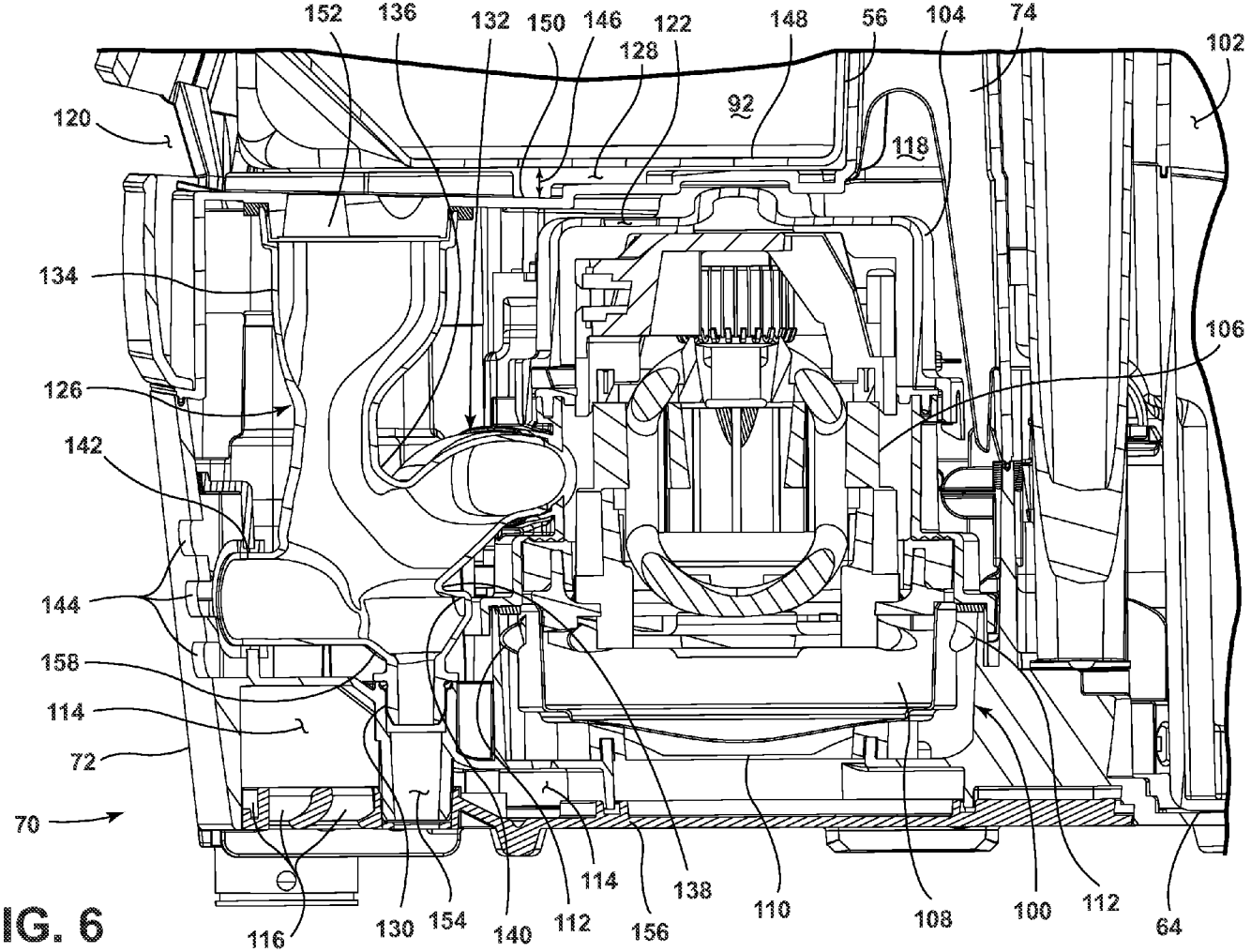
FIG. 6 is a cross-sectional view through line VI-VI of FIG. 4 showing a portion of the pod.

FIG. 6 is a cross-sectional view through line VI-VI of FIG. 4 showing a portion of the pod 70. The pod housing 72 contains a motor housing 104 in which the motor/fan assembly 100 is mounted. The motor/fan assembly 100 includes a suction motor 106 with an attached impeller assembly 108 having an impeller inlet 110 and at least one impeller outlet 112. The impeller inlet 110 is in fluid communication with an outlet of the recovery chamber 102. A working air exhaust passage 114 is fluidly formed between the impeller outlet(s) 112 and an exhaust outlet 116, which can be formed in a bottom surface of the pod housing 72. The exhaust outlet 116 can include an exhaust grill having a plurality of openings.

A motor-cooling air pathway is provided in the pod 70 for providing cooling air to the suction motor 106 and for removing heated cooling air (also referred to herein as "heated air") from the suction motor 106. The motor-cooling air pathway includes an ambient air inlet 118 which is fluidly upstream of the suction motor 106, and an ambient air outlet 120 which is fluidly downstream of the suction motor 106. Both the inlet 118 and the outlet 120 are in fluid communication with the ambient air outside the pod 70. The ambient air inlet 118 can be provided by a passage through the carry handle 74 that extends to the suction motor 106. The ambient air outlet 120 can be provided in the pod housing 72, near the supply tank 56. A portion of the motor-cooling air pathway downstream of the motor 100 can extend near the supply tank 56, such that cooling air heated by the suction motor 106 can be used to heat the liquid inside the supply tank 56. The motor housing 104 includes at least one aperture 122 for allowing cooling air to enter the motor housing 104 and pass over the suction motor 106. The aperture 122 is in fluid communication with the ambient air inlet 118.

A duct system is provided which permits heated motor cooling air to be delivered from the suction motor 106 to the supply tank 56, but which does not permit liquid from the supply tank 56, i.e. due to leakage from the supply tank 56, to enter the suction motor 106. The duct system can include a heat transport duct 126, a heat transfer duct 128, and a liquid drain duct 130. As shown herein, the ducts 126-130 of the duct system can be an integrally formed one-piece article, which can be a blow-molded or injection-molded part; alternatively, separate ducts can be provided and can be attached using suitable, fluid-tight connections.

The heat transport duct 126 can extend from the motor housing 104 to the supply tank 56 for allowing heated motor cooling air to be transported away from the suction motor 106 toward the supply tank 56. The heat transport duct 126 can have an angled duct segment 132 which juts outwardly from the motor housing 104 to join to a vertical duct segment 134. The vertical duct segment 134 opens to the heat transfer duct 128.

The angled duct segment 132 joins the vertical duct segment 134 at an upper corner 136 and joins the liquid drain duct 130 at a lower corner 138. A ribbed section 140 is provided at the lower corner 138. An optional bleed hole 142 can be provided in the vertical duct segment 134 for venting a portion of the heated motor cooling air from the duct system. The presence of the bleed hole 142 can reduce overheating of the suction motor 106 by limiting backpressure within the duct system and increasing the volume of cooling air that can pass over the suction motor 106. A ventilation opening 144 can be provided in the pod housing 72 and aligned with the bleed hole 142 for exhausting bleed air out of the pod housing 72.

The heat transfer duct 128 can be open to or in contact with a portion of the supply tank 56. As shown herein, the heat transfer duct 128 extends along a gap 146 formed between a bottom wall 148 of the supply tank 56 and a platform 150 on the pod housing 70 on which the supply tank 56 rests. The platform 150 can include an outlet grill 152 dividing the vertical duct segment 134 from the heat transfer duct 128.

The liquid drain duct 130 extends downwardly from the heat transport duct 126, below the ribbed section 140, to a drain outlet 154 formed in a bottom wall 156 of the pod housing 72. A portion of the liquid drain duct 130 can be formed as a funnel 158 to encourage liquid to move toward the drain outlet 154

Figure 7:
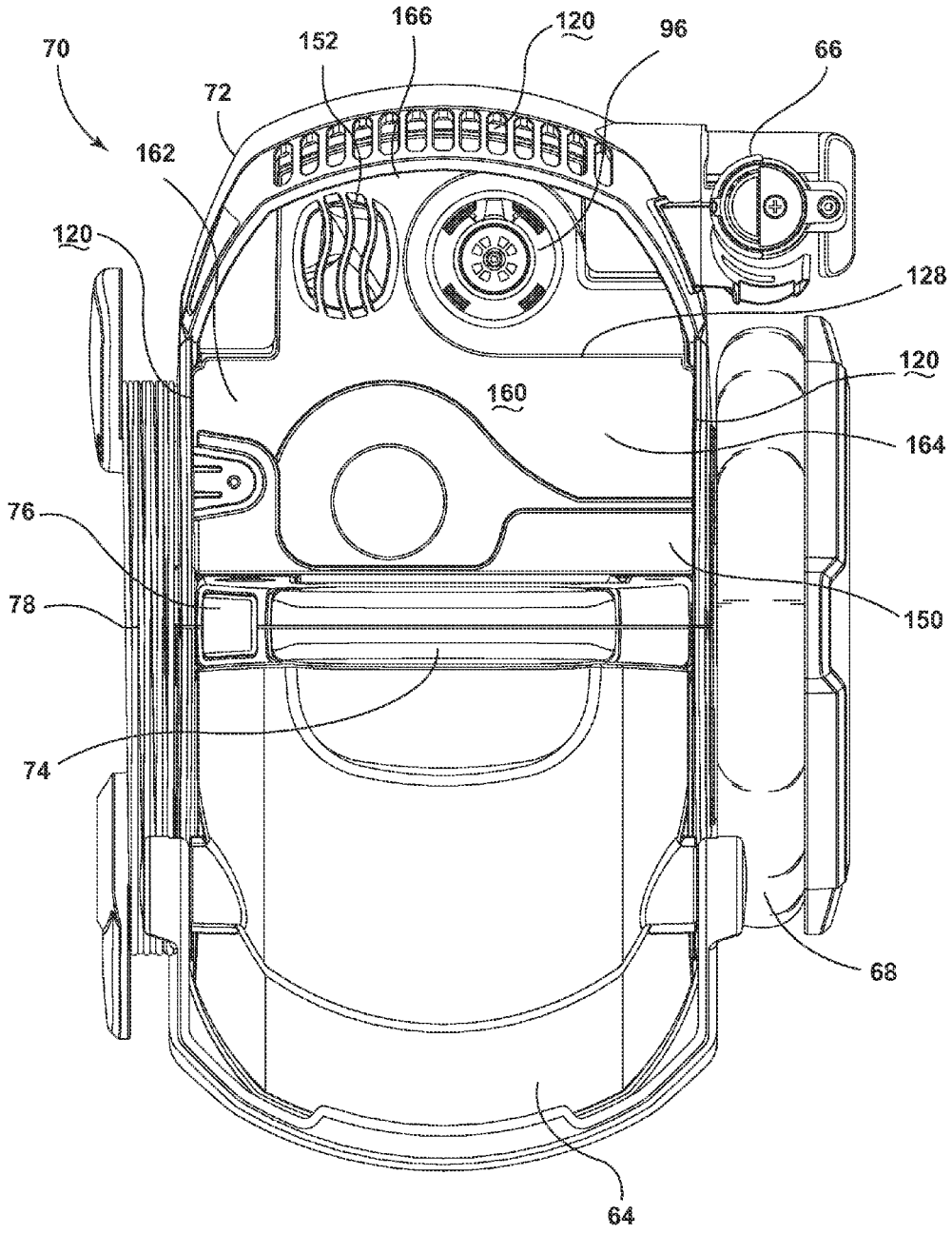
FIG. 7 is a top view of the pod, with a supply tank removed for clarity.

FIG. 7 is a top view of the pod 70, with the supply tank 56 removed for clarity to show the details of the heat transfer duct 128. The heat transfer duct 128 formed between the supply tank 56 and the platform 150 on the pod housing 72 can be partially formed by a recess 160 in the platform 150 that is configured to maximize contact area between the supply tank 56 and the heated cooling air. As shown herein, the recess 160 can include three branches, a right lateral branch 162, a left lateral branch 164, and a middle branch 166, with the terminal ends of the branches 162, 164, 166 forming the ambient air outlets 120.

A description of the operation of the extractor 50 with respect to the duct system follows. Further details of the operation of the extractor 50, including the liquid distribution and recovery systems, and the use of the pod 70 on the extractor 50 and alone, can be found in U.S. Patent App. Pub. No. 2012/0222235 to Lenkiewicz et al., referenced above.

Figure 8:
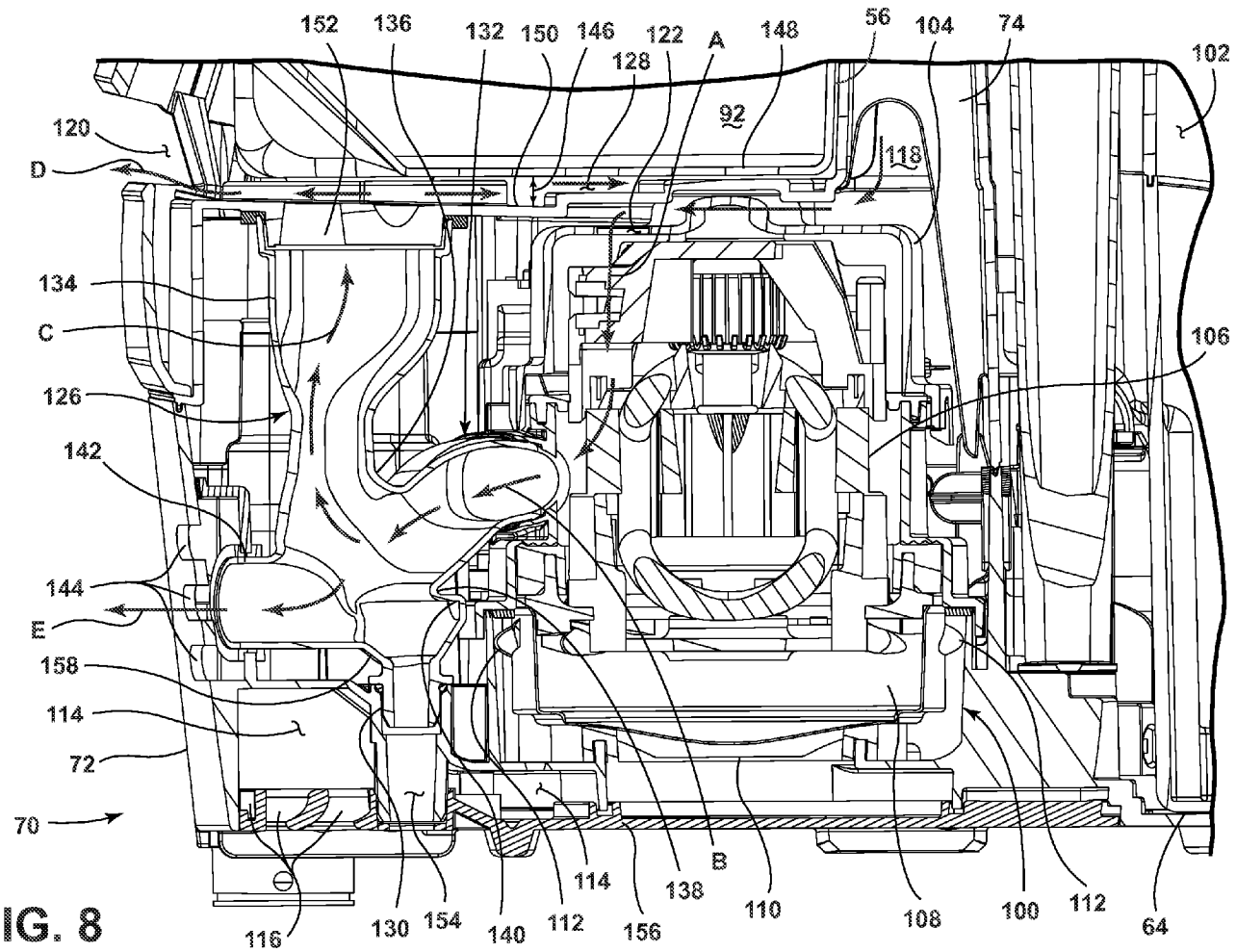
FIG. 8 is a view similar to FIG. 6, illustrating the flow of motor cooling air through the extraction cleaner.

FIG. 8 illustrates the flow of motor cooling air through the duct system. During operation of the suction motor 106, ambient cooling air enters the pod housing 70 through the ambient air inlet 118, and enters the motor housing through the aperture 122 as indicated by arrow A. As the cooling air passes the suction motor 106, heat from the suction motor 106 is transferred to the cooling air, thereby cooling the suction motor 106 and heating the cooling air. The heated cooling air ("heated air") exits the motor housing 104 via the angled duct segment 132, which directs the heated air into the vertical duct segment 134, as indicated by arrow B. The ribbed section 140 helps guide heated air upwardly to the vertical duct segment 134, rather than into the liquid drain duct 130 by creating a tortuous air path. The heated air flows upwardly to the heat transfer duct 128, and flows adjacent to the supply tank 56, as indicated by arrow C. While in the heat transfer duct 128, heat from the heated air is transferred to the liquid inside the supply tank 56 through the bottom wall 148 of the supply tank 56. As the heated air passes through the heat transfer duct 128, and heat is transferred to the supply tank 56, the heated air will cool. The cooled air can have the same temperature as the ambient cooling air drawn in through the inlet 118, or may be slightly warmer or cooler. The cooled air will then exit the pod housing 72 through the ambient air outlets 120, as indicated by arrow D. A portion of the heated air can be vented from the duct system via the bleed hole 142 and ventilation opening 144, as indicated by arrow E.

Figure 9:
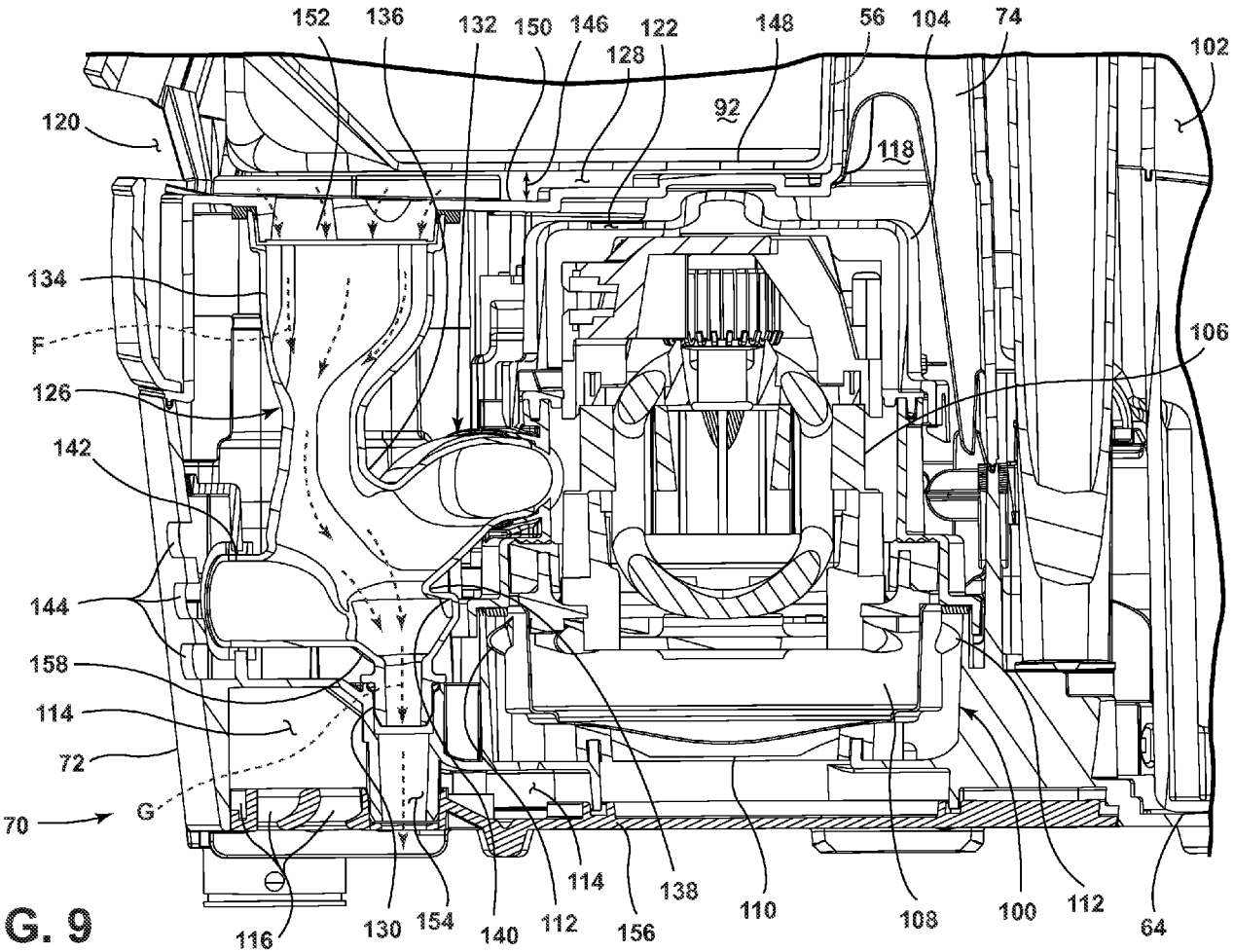
FIG. 9 is a view similar to FIG. 6, illustrating the flow of liquid through the extraction cleaner.

FIG. 9 illustrates the flow of liquid through the duct system 22. Liquid can leak from the supply tank 56 during installation or removal of the supply tank 56 from the pod 70, such as from when the valve 94 engages the valve seat 96 or if the valve 94 is installed incorrectly. The exterior of the supply tank 56 can also be wet from the filling process. Liquid from the supply tank 56 falls into the liquid drain duct 130 via the vertical duct segment 134, as indicated by arrow F, and passes out of the pod housing 72 via the drain outlet 154, as indicated by arrow G. The angled duct segment 132 is provided at an upwardly inclined angle to the vertical duct segment 134 in order to prevent liquid from entering the motor housing 104 and suction motor 106. Further, the corners 136, 138 of the angled duct segment 132 can be offset, such that the upper corner 136 is closer to the center of the vertical duct segment 134 than the lower corner 138, which directs liquid toward the liquid drain duct 130 rather than toward the angled duct segment 132.

The method and apparatus disclosed herein provides an extraction cleaner with a duct system that is configured to guide heated motor cooling exhaust air to the supply tank to heat the liquid inside the supply tank. Conventional extraction cleaners require a heater to heat the liquid inside the supply tank. One advantage that may be realized in the practice of some embodiments of the described duct system reuses motor cooling air for the purposes of heating the liquid in the supply tank before exhausting the motor cooling air from the extraction cleaner, without requiring a separate heater. This reduces the cost and weight of the extraction cleaner.

Another advantage that may be realized in the practice of some embodiments of the described duct system is that the duct system is configured to prevent liquid ingress from the supply tank into the motor compartment. Such liquid ingress is inherent to many extraction cleaners; undesirable liquid ingress and liquid exposure to live components during agency-required testing can present a major problem. In the embodiment used to illustrate the invention, the duct system includes a drain hole, an air bleed hole, and a torturous air path. The features, alone or in combination, are effective at preventing liquid ingress into the motor compartment, even though the duct system can be located directly below the supply tank, and above (and fluidly connected with) the motor.

The disclosed embodiments are representative of preferred forms of the invention and are intended to be illustrative rather than definitive of the invention. The illustrated upright extractor is but one example of the variety of deep cleaners with which this invention or some slight variant can be used. Reasonable variation and modification are possible within the forgoing disclosure and drawings without departing from the scope of the invention which is defined by the appended claims.

What is claimed is:

1. An extraction cleaner for cleaning a floor surface, comprising:
- a supply tank configured to store a supply of cleaning liquid;
- a liquid distribution system configured to apply the cleaning liquid to the floor surface;
- a liquid recovery system configured to recover applied liquid and dirt from the floor surface, the liquid recovery system comprising:
  - a recovery tank configured to store recovered cleaning liquid and dirt;
  - a suction nozzle in fluid communication with the recovery tank; and
  - a motor generating working air flow;
- a motor-cooling air pathway providing cooling air to the motor and removing heated cooling air from the motor; and
- a duct system fluidly downstream of the motor and comprising:
  - a heat transfer duct fluidly coupled to the motor-cooling air pathway and delivering heated motor cooling air from the motor to the supply tank to heat the cleaning liquid stored therein; and
  - a drain outlet fluidly coupled to the heat transfer duct, wherein the drain outlet drains cleaning liquid that enters the heat transfer duct away from the motor.

2. The extraction cleaner from claim 1, wherein the duct system further comprises a liquid drain duct defining the drain outlet and which directs cleaning liquid that enters the heat transfer duct away from the motor.

3. The extraction cleaner from claim 2, wherein the liquid drain duct comprises a funnel to encourage liquid to move toward the drain outlet.

4. The extraction cleaner from claim 1, and further comprising a motor housing, wherein the motor is provided within a motor housing.

5. The extraction cleaner from claim 4, wherein the duct system further comprises a heat transport duct extending from the motor housing to the heat transfer duct for transporting heated motor cooling air away from the motor toward the supply tank.

6. The extraction cleaner from claim 5, wherein the heat transport duct comprises a vertical duct segment in fluid communication with the heat transfer duct and an angled duct segment which juts outwardly from an outlet of the motor housing to join to the vertical duct segment.

7. The extraction cleaner from claim 6, wherein the angled duct segment is provided at an upwardly inclined angle to the vertical duct segment in order to prevent liquid from entering the motor housing.

8. The extraction cleaner from claim 6, wherein the liquid drain duct extends downwardly from the heat transport duct to the drain outlet.

9. The extraction cleaner from claim 6, wherein the duct system comprises a tortuous air path that guides heated air toward the vertical duct segment rather than the liquid drain duct.

10. The extraction cleaner from claim 9, wherein the tortuous air path comprises a ribbed section between the heat transport duct and the liquid drain duct.

11. The extraction cleaner from claim 10, wherein the angled duct segment joins the vertical duct segment at an upper corner and joins the liquid drain duct at a lower corner, and the ribbed section is provided at the lower corner.

12. The extraction cleaner from claim 11, wherein the corners of the angled duct segment are offset, such that the upper corner is closer to the center of the vertical duct segment than the lower corner to direct liquid toward the liquid drain duct rather than toward the angled duct segment.

13. The extraction cleaner from claim 1, wherein the duct system comprises an air bleed hole for venting a portion of the heated motor cooling air from the duct system.

14. The extraction cleaner from claim 1, wherein the duct system comprises a tortuous air path that guides heated air toward the heat transfer duct rather than the drain outlet.

15. The extraction cleaner from claim 1, wherein the heat transfer duct passes adjacent to a bottom surface of the supply tank.

16. The extraction cleaner from claim 1, wherein the supply tank comprises a removable supply chamber for storing the cleaning liquid and includes a valve selectively closing an outlet of the chamber.

17. The extraction cleaner from claim 16, and further comprising a valve seat for opening the valve when the supply chamber is mounted to the extraction cleaner.

18. The extraction cleaner from claim 1, wherein the heat transfer duct comprises multiple branches that extend adjacent to the supply tank.

19. The extraction cleaner from claim 18, wherein each of the multiple branches comprises an ambient air outlet.

20. The extraction cleaner from claim 1, and further comprising a removable pod, wherein at least the supply tank, recovery tank, and motor are provided on the pod.

* * * * *